US008955893B1

(12) United States Patent
Stern et al.

(10) Patent No.: US 8,955,893 B1
(45) Date of Patent: Feb. 17, 2015

(54) ANIMAL WASTE REMOVAL TOOL

(71) Applicants: Jeffrey Louis Stern, Big Lake, MN (US); Arthur Louis Stern, Jr., Cedar Lake, IN (US)

(72) Inventors: Jeffrey Louis Stern, Big Lake, MN (US); Arthur Louis Stern, Jr., Cedar Lake, IN (US)

( * ) Notice: Subject to any disclaimer, the term of this patent is extended or adjusted under 35 U.S.C. 154(b) by 0 days.

(21) Appl. No.: 14/247,691

(22) Filed: Apr. 8, 2014

(51) Int. Cl.
*A01K 29/00* (2006.01)
*E01H 1/12* (2006.01)

(52) U.S. Cl.
CPC ..... *E01H 1/1206* (2013.01)
USPC ..... 294/1.4; 294/214

(58) Field of Classification Search
USPC ..... 294/1.4, 1.3, 1.5, 214, 57, 55.5, 51, 52, 294/53.5, 50.8, 50.9; 56/400.11, 400.21, 56/400.12
See application file for complete search history.

(56) References Cited

U.S. PATENT DOCUMENTS

| | | | | | |
|---|---|---|---|---|---|
| 501,430 | A | * | 7/1893 | Knight | 56/400.13 |
| 978,661 | A | * | 12/1910 | Schwartzman | 294/55.5 |
| 2,326,676 | A | | 8/1943 | Peters | |
| 2,666,662 | A | * | 1/1954 | McLeod | 294/176 |
| 3,310,332 | A | | 3/1967 | Nelson | |
| 3,688,483 | A | * | 9/1972 | Hamilton | 56/400.11 |
| 3,733,099 | A | * | 5/1973 | Szita | 294/214 |
| 3,767,249 | A | * | 10/1973 | Rogers | 294/49 |
| 4,138,153 | A | * | 2/1979 | Brown | 294/1.4 |
| 4,316,627 | A | | 2/1982 | Solypa | |
| 4,828,690 | A | * | 5/1989 | Montez | 209/418 |
| 4,865,372 | A | * | 9/1989 | Gabriel | 294/49 |
| 5,060,343 | A | * | 10/1991 | Nisenbaum | 16/421 |
| 5,562,318 | A | * | 10/1996 | McBroom | 294/1.4 |
| 5,868,447 | A | * | 2/1999 | Clark et al. | 294/1.4 |
| 5,921,596 | A | | 7/1999 | Sheriff | |
| 6,003,913 | A | | 12/1999 | Flumiani | |
| 6,030,011 | A | * | 2/2000 | Layton | 294/1.4 |
| D437,462 | S | | 2/2001 | Whall | |
| 6,196,600 | B1 | | 3/2001 | Miller | |
| 6,312,029 | B1 | | 11/2001 | Renforth | |
| 6,412,841 | B1 | | 7/2002 | Loraas | |
| 6,554,334 | B2 | | 4/2003 | Uribe | |
| 6,641,188 | B2 | | 11/2003 | Arceo | |
| 6,820,628 | B2 | | 11/2004 | Larson | |
| 7,044,519 | B2 | * | 5/2006 | Raguse | 294/214 |
| 7,111,741 | B2 | | 9/2006 | Bramante | |
| 7,686,360 | B2 | * | 3/2010 | Platt | 294/1.3 |
| 7,870,835 | B2 | | 1/2011 | Amerena | |
| 7,914,056 | B1 | * | 3/2011 | Peterman | 294/1.3 |
| 8,016,118 | B2 | | 9/2011 | Boll | |
| 8,038,190 | B2 | | 10/2011 | Zidulka | |
| 8,262,145 | B2 | | 9/2012 | Berto | |
| 8,449,007 | B2 | * | 5/2013 | Farmer | 294/1.4 |
| D686,787 | S | | 7/2013 | Dabrushman | |
| 8,474,890 | B2 | | 7/2013 | Buhagiar | |
| 8,511,728 | B2 | | 8/2013 | Beaton | |
| 2004/0164568 | A1 | | 8/2004 | Diehl | |
| 2009/0058114 | A1 | | 3/2009 | Diehl | |

(Continued)

FOREIGN PATENT DOCUMENTS

| | | | | |
|---|---|---|---|---|
| DE | 102009012276 | | 9/2010 | |
| DE | 102009012276 | A1 * | 9/2010 | A01D 11/00 |

*Primary Examiner* — Saul Rodriguez
*Assistant Examiner* — Gabriela Puig
(74) *Attorney, Agent, or Firm* — Haugen Law Firm PLLP

(57) ABSTRACT

An animal waste removal tool is described that may be utilized alone or in conjunction with a waste bag. The waste removal tool of the invention includes tines that guide waste into the receptacle and a handle that extends over and above the tines.

20 Claims, 19 Drawing Sheets

(56) References Cited

U.S. PATENT DOCUMENTS

2009/0261608 A1* 10/2009 Berto ..... 294/55.5
2011/0181064 A1* 7/2011 Moore ..... 294/1.4
2011/0309645 A1 12/2011 Briscoe
2013/0026773 A1 1/2013 Rockwell et al.
2013/0146319 A1 6/2013 Truex

* cited by examiner

ANIMAL WASTE REMOVAL TOOL

CROSS-REFERENCE TO RELATED APPLICATIONS

Not Applicable

FEDERAL SPONSORSHIP

Not Applicable

JOINT RESEARCH AGREEMENT

Not Applicable

TECHNICAL FIELD

This invention pertains generally to an object scoop. More particularly, the invention pertains to a scoop particularly well suited as an animal waste removal tool.

BACKGROUND

Over the years many apparatus have been devised to aid an animal owner in cleaning up the waste of their animal from the ground. Although a simple shovel may be used to scoop under the waste the shovel may also inadvertently scoop up a portion of the underlying ground. Today, many animal owners have well maintained and manicured lawns making it undesirable to use a shovel to scoop up the waste. Further, the waste may become entangled in tall, thick grass of these lawns, making removal of the waste difficult without damaging the lawn.

Additionally, although shovels and pitch forks have been used in the past to scoop waste, use of a shovel or pitch fork requires an undesirable pushing motion to scoop up the waste. Also, once the waste is scooped with a shovel or pitch fork, two hands are required to lift and balance the waste on the shovel or forks. Further, the pushing and lifting may require an undesirable bending or twisting motion by the user. There is accordingly a need for a waste removal tool that may be pulled through and over grass to remove waste from the grass without causing damage to the lawn. There is a further need for a tool that is operable by the user in an up-right, standing or walking position that also allows the user to scoop and lift waste with a one hand operation.

SUMMARY

Embodiments according to aspects of the invention provide an animal waste removal tool that facilitates the scooping of waste enmeshed in thick grass. The tool includes spaced apart tines that are offset and angled to easily slide through entangled grass and underneath waste left on the grass. Once the tines are positioned under the waste, the handle may be rotated up and away from the user. A receptacle or bucket is attached to the tines and handle. The upward rotation of the handle also rotates the tines upward causing the waste to lift up and away from the grass and displace into the bucket. Those familiar with the use of shovels and pitch forks will appreciate that an upward rotation to displace the waste is preferred over forcing down on a handle to rotate a shovel or fork upward.

In accordance with aspects of the invention, an embodiment of the invention includes a handle attached to a waste receptacle in a manner that allows the user to pull the receptacle towards the user while sliding tines under the waste. The attachment of the handle to the receptacle also allows the user to rotate the handle up and away from the user to displace waste into the receptacle. The waste receptacle has a forward facing edge that defines an opening into the receptacle. A row of tines extend from the forward facing edge of the receptacle. The row of tines are offset from a lower outer edge of the receptacle to further facilitate sliding the tines under the waste. The row of tines may also include an outer tine on each end of the row of tines that is not offset from the lower outer edge of the receptacle. The outer tines restrict the waste from falling off either side of the row of tines.

In accordance with aspects of the invention, the row of tines are attached to the receptacle in a fixed relation. Alternatively, the row of tines may be attached to the receptacle with a hinge arrangement that allows the tines to be clamped to or removed from the receptacle. When using the removable tines, prior to attaching the tines, an open end of a waste bag may overlap the opening of the receptacle with the remaining portion of the bag positioned within the receptacle. The tines may then attach to the receptacle to effectively clamp a portion of the bag between the receptacle and tines. A retention member located on an upper portion of the receptacle may also engage and hold in place an additional portion of the bag. Without limitation intended a portion of the retention member may be magnetic and the receptacle may include a metal portion aligned with the retention member such that the waste bag may be sandwiched between the magnetic retention member and the metal portion of the receptacle.

In accordance with an embodiment of the invention the tool is particularly well suited to scoop under a desired object that may then be further directed into a holding receptacle. The holding receptacle has a forward facing edge defining an opening into the receptacle. A row of tines extending from the forward facing edge of the receptacle are offset from a lower outer edge of the receptacle. The offset tines further facilitate scooping under the desired object. A handle is affixed to a rear portion of the receptacle. Although the tines are affixed to the receptacle, the tine arrangement includes a hinging and clamping mechanism and a clip member that clips the row of tines to the lower outer edge of the receptacle. When unclamped, the hinge allows the tines to rotate away from the receptacle and allows for complete separation of the receptacle from the bag. The tines may further include an outer tine on each end of the row of tines that is not offset from the lower outer edge of the receptacle. The outer tines may act as guards or rails to restrict an object from moving off a side of the row of tines. The receptacle may further be adapted to receive a bag such that scooped objects are guided directly into the bag.

The accompanying drawings, which are incorporated in and constitute a portion of this specification, illustrate embodiments of the invention and, together with the detailed description, serve to further explain the invention. The embodiments illustrated herein are presently preferred; however, it should be understood, that the invention is not limited to the precise arrangements and instrumentalities shown. For a fuller understanding of the nature and advantages of the invention, reference should be made to the detailed description in conjunction with the accompanying drawings.

DESCRIPTION OF THE DRAWINGS

In the various figures, which are not necessarily drawn to scale, like numerals throughout the figures identify substantially similar components.

DETAILED DESCRIPTION

Figure 1:
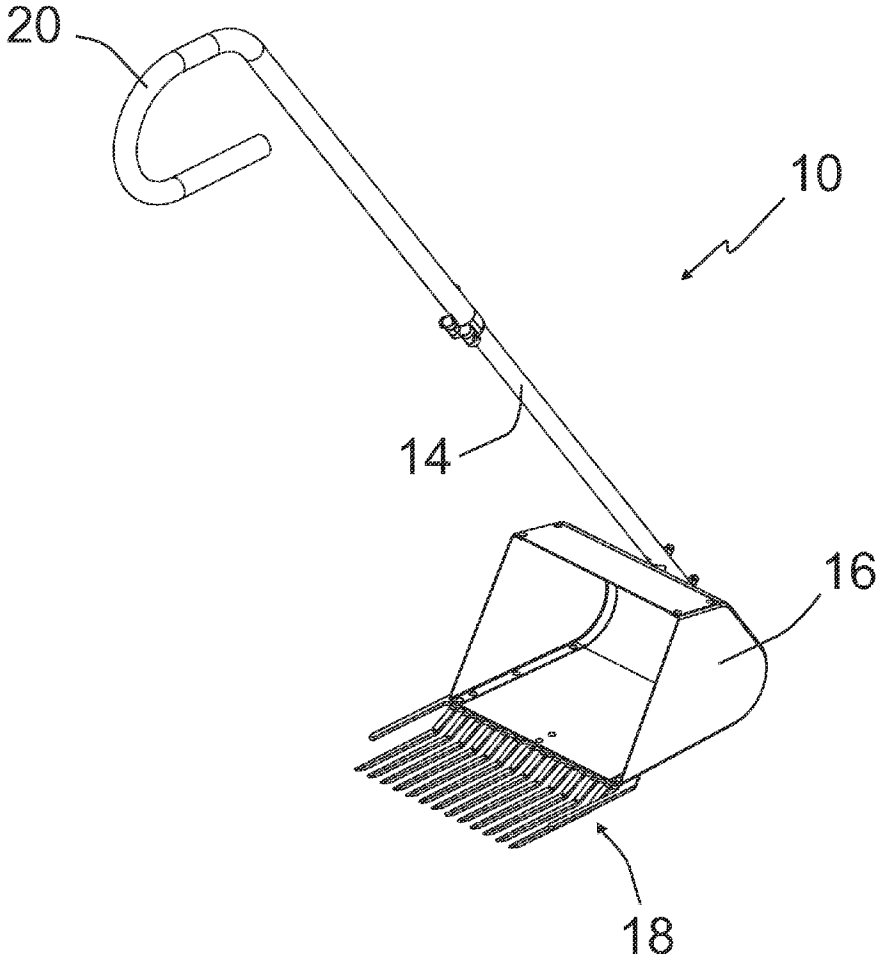
FIG. 1 is a front right perspective view of a waste removal tool in accordance with an embodiment of the invention.
Figure 2:
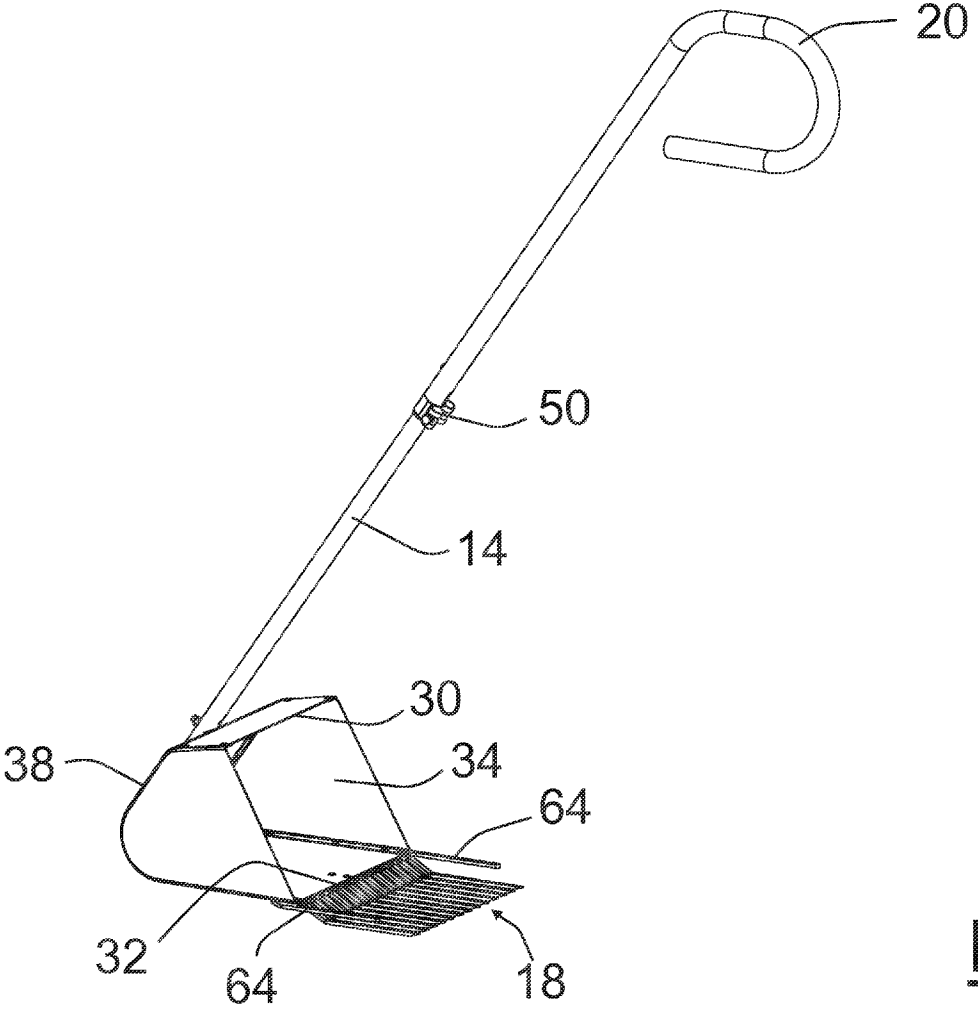
FIG. 2 is a front left perspective view of the waste removal tool of the type shown in FIG. 1.
Figure 3:
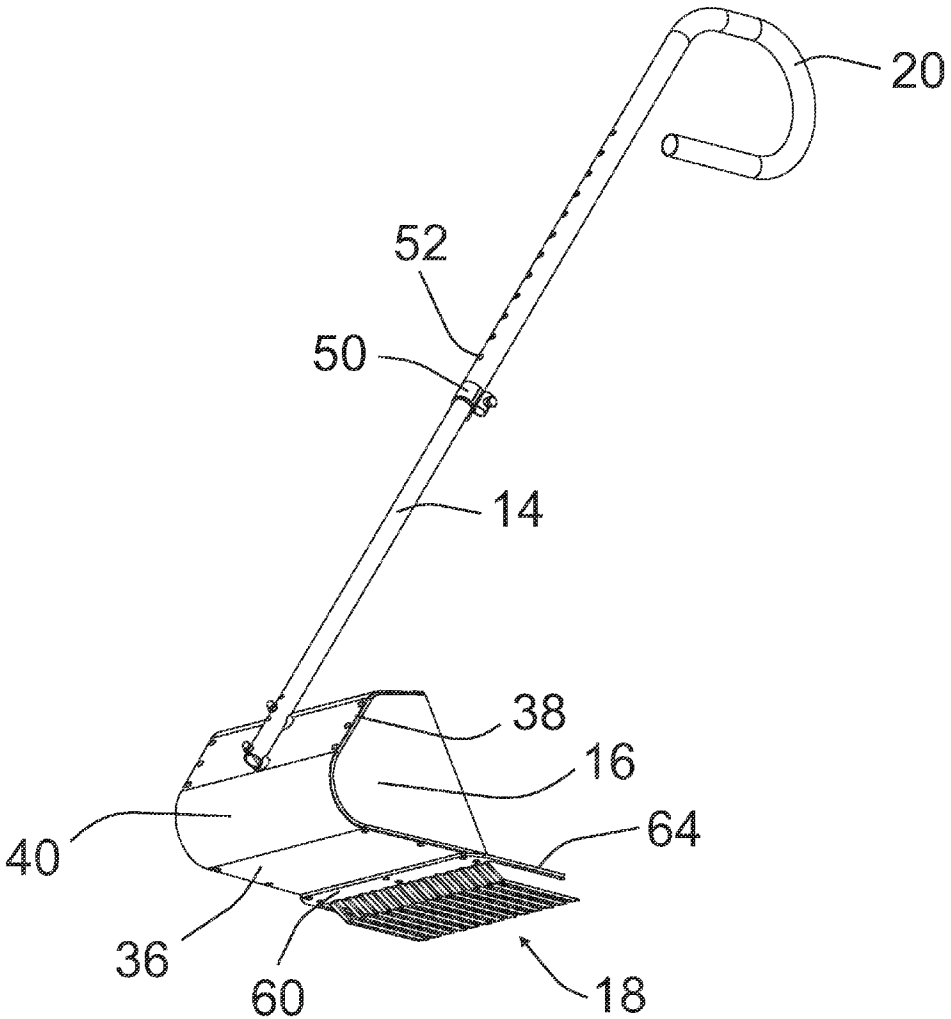
FIG. 3 is a left back perspective view of the waste removal tool of the type shown in FIG. 1.
Figure 4:
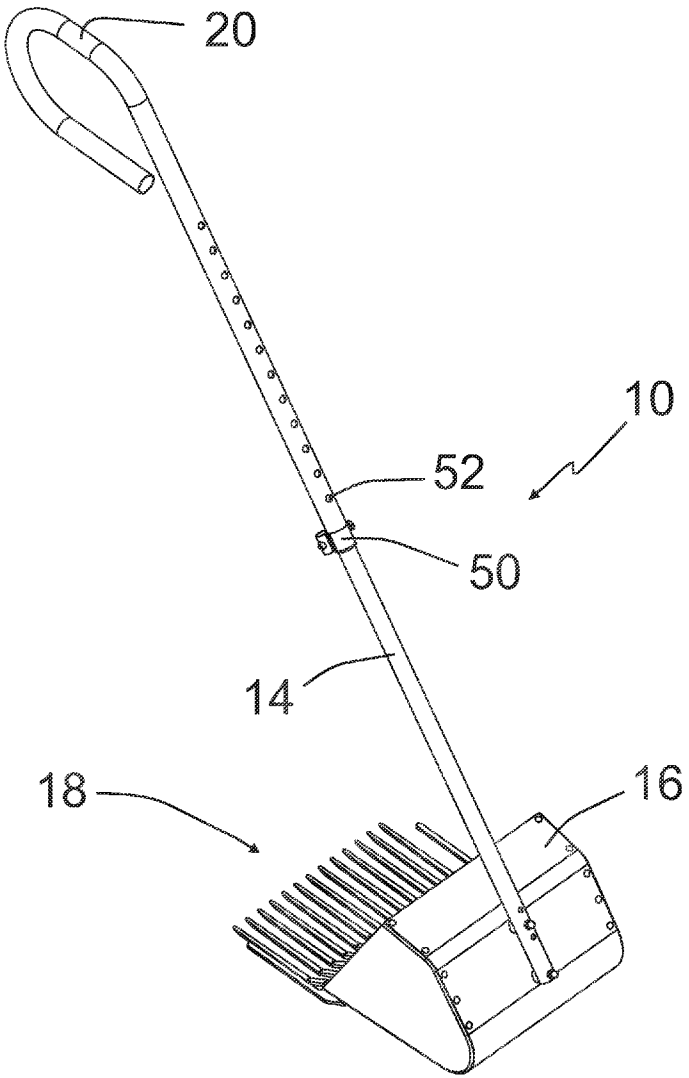
FIG. 4 is a right back perspective view of the waste removal tool of the type shown in FIG. 1.
Figure 5:
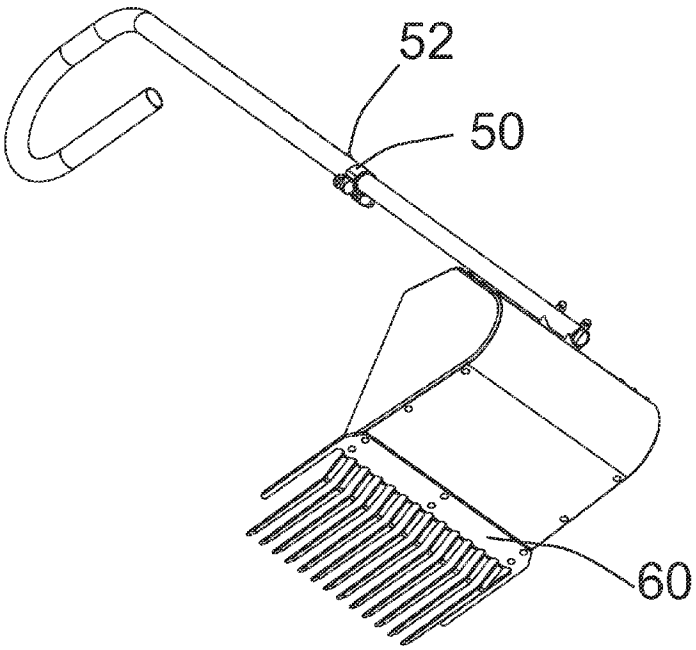
FIG. 5 is a bottom perspective view of the waste removal tool of the type shown in FIG. 1.

The following description provides detail of various embodiments of the invention, one or more examples of which are set forth below. Each of these embodiments are provided by way of explanation of the invention, and not intended to be a limitation of the invention. Further, those skilled in the art will appreciate that various modifications and variations may be made in the present invention without departing from the scope or spirit of the invention. By way of example, those skilled in the art will recognize that features illustrated or described as part of one embodiment, may be used in another embodiment to yield a still further embodiment. Thus, it is intended that the present invention also cover such modifications and variations that come within the scope of the appended claims and their equivalents.

The waste removal tool 10 of the present invention generally includes a handle 14, a bucket, receptacle, or scoop 16, tines 18, and hand grip 20. The bucket 16 is shaped and the handle 14 is attached to the bucket in a manner that removal of waste from the ground while walking or standing in an upright position. A row of tines 18 are attached to the bucket but are offset below a bottom of the bucket. The offset tines 18 slide through entangled grass while the bottom of the bucket may remain elevated above the grass. In this manner the waste may be removed from the grass with reduced snagging and drag. In various embodiments depicted in the Figures handle 14 is extendable between a short and long handle. To modify the length of the handle 14, the user loosens handle clamp 50 and depresses adjustable stop 52. The handle may then extend or retract until the adjustable stop 52 engages another aligned aperture.

With reference to the Figures, the waste removal tool 10 is described in greater detail. FIGS. 1-5 illustrate an embodiment of the waste removal tool 10 having a row of tines 18 attached to the waste receptacle 16. The waste receptacle 16 includes an outer perimeter edge 30 that defines an opening of the receptacle. The receptacle further includes enclosed sides 34, a bottom 36, an angled back 38 and a rounded back rocker panel 40. The opening is further defined by lower edge 32 to which the row of tines 18 is attached. The tines may be made integral with the waste receptacle or may be made separately and attached to the receptacle at the lower edge 32. The attachment may include fasteners, welds, adhesives or other structure to join the tines to the lower edge, with a rivet being preferred. Those skilled in the art will appreciate that the bucket and tines may be constructed from several desirable materials using known methods of construction including die stamping, sheet metal formation, and plastic molding.

The row of tines 18 includes tine plate 60 that attaches to the bottom 36 of the bucket 30. The plurality of tines extend from the tine plate at an angle to form an angled portion 66 of the row of tines. The tines are further angled to extend parallel with the tine plate 60 to define an offset portion 68 of the tines. Each tine terminates at a chisel shaped end 62. Those skilled in the art will appreciate that flat tines constructed from a heavy gauge steel or aluminum sheet material provides desirable strength and rigidity.

Figure 6:
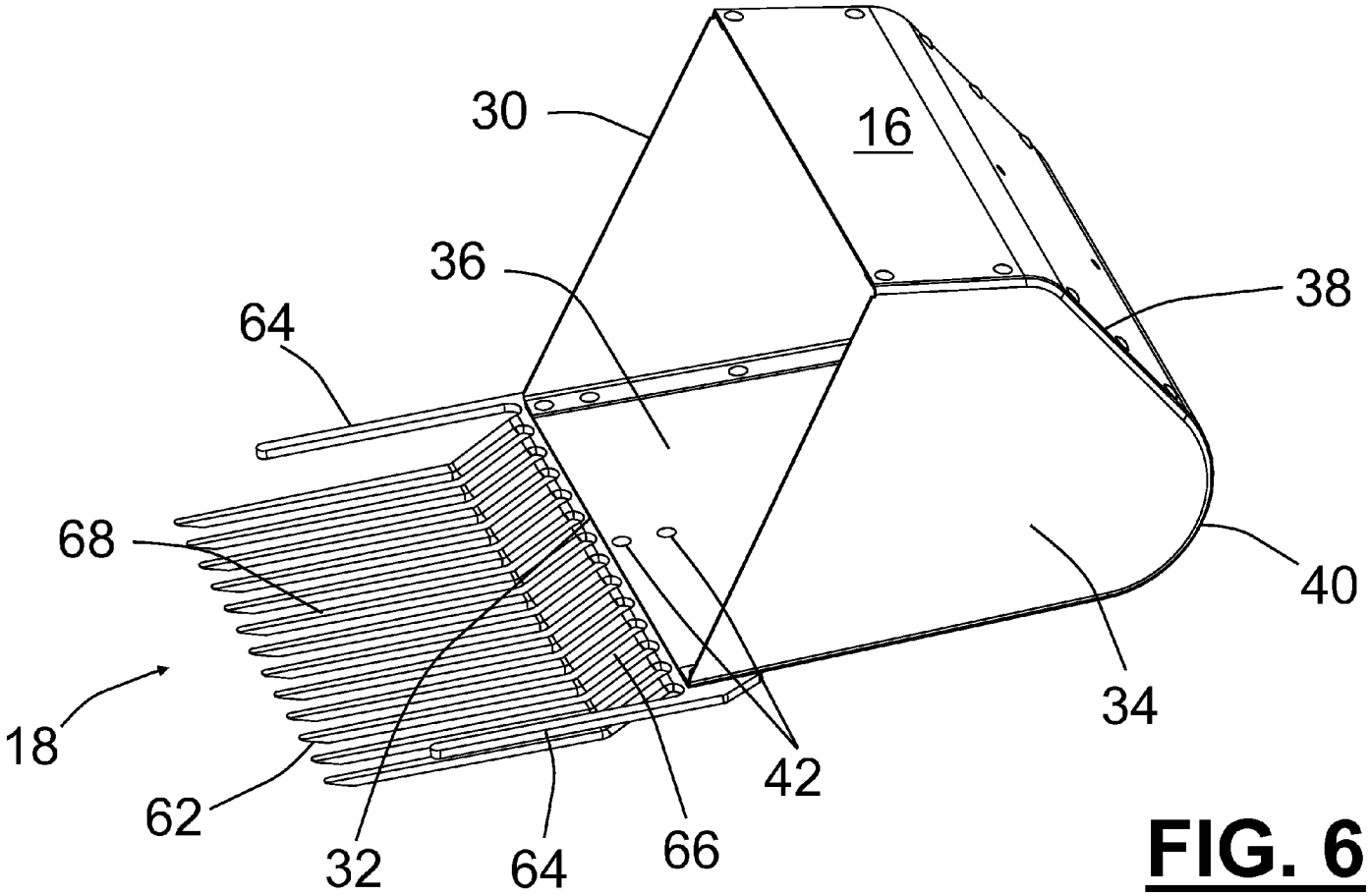
FIG. 6 is a front right perspective view of a scoop and tines in accordance with an embodiment of the invention.
Figure 7:
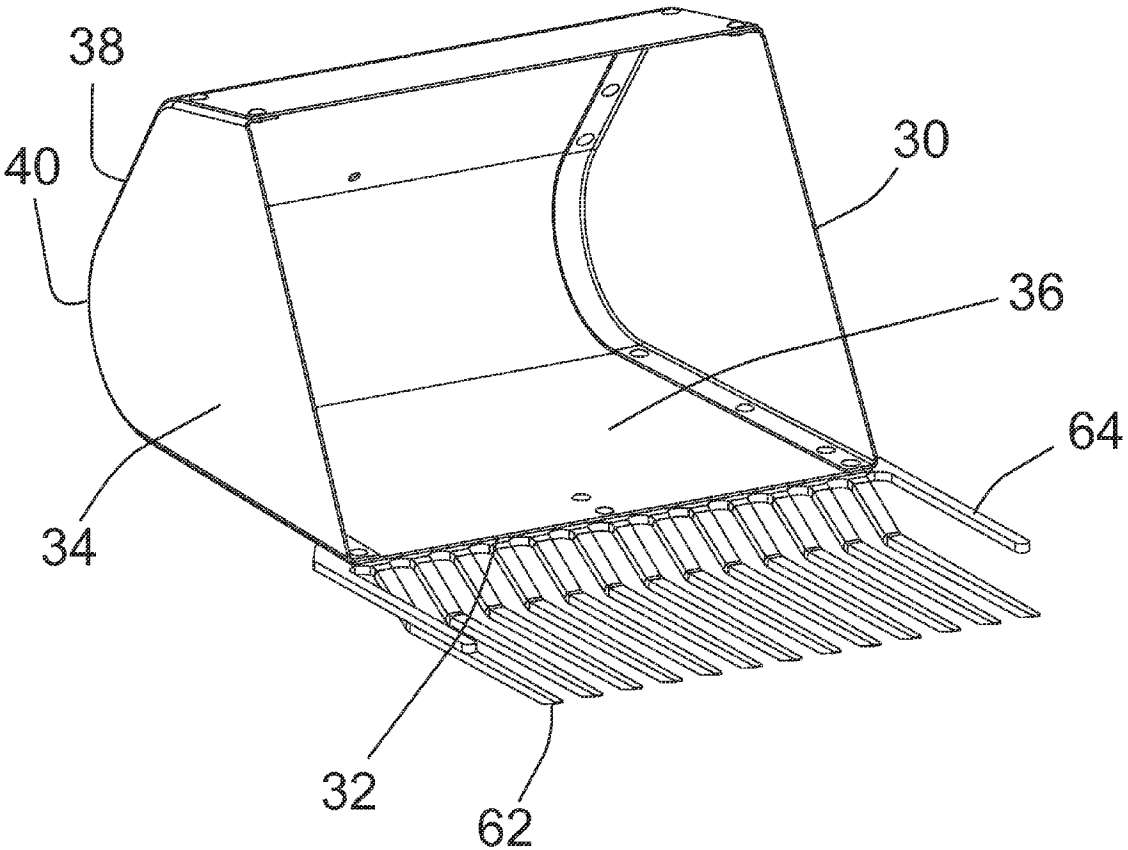
FIG. 7 is a front left perspective view of the scoop and tines of the type shown in FIG. 6.

FIGS. 6 and 7 illustrate an embodiment of the tines 18 and bucket 34. Outer tines 64 extend from the outer ends of the tine plate 60 parallel with the tine plate. The outer tines may act as rails or guides to direct waste into the bucket and restrict movement off the ends of the row of tines. The tine plate 60 is illustrated as attached to the bucket 16 with rivets 42. Alternatively, as illustrated in FIGS. 16-19, the tine plate 60 extends under the bottom of the bucket to form tine frame 70. A handle 72 is rotatably attached to frame 70 at hinge 78. End portions of the handle 72, attached to form a portion of hinge 78, include a slot 80. Also attached to the tine handle 72 is a spring clamp 74 that is sized to clamp and engage handle 14. Clips 76 are attached to tine frame 70 to form channels 84 (see FIG. 17) that the lower edge 32 of the buckets slides into and engages.

Figure 8:
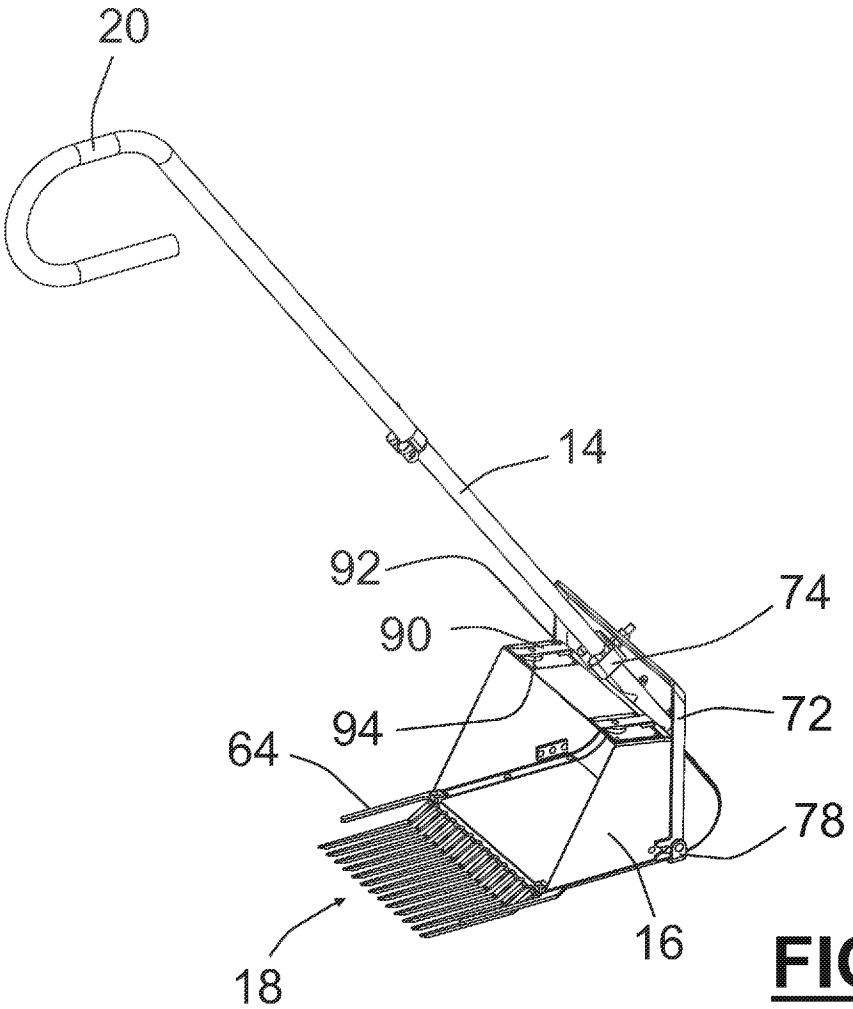
FIG. 8 is a front right perspective view of a waste removal tool in accordance with an embodiment of the invention.
Figure 9:
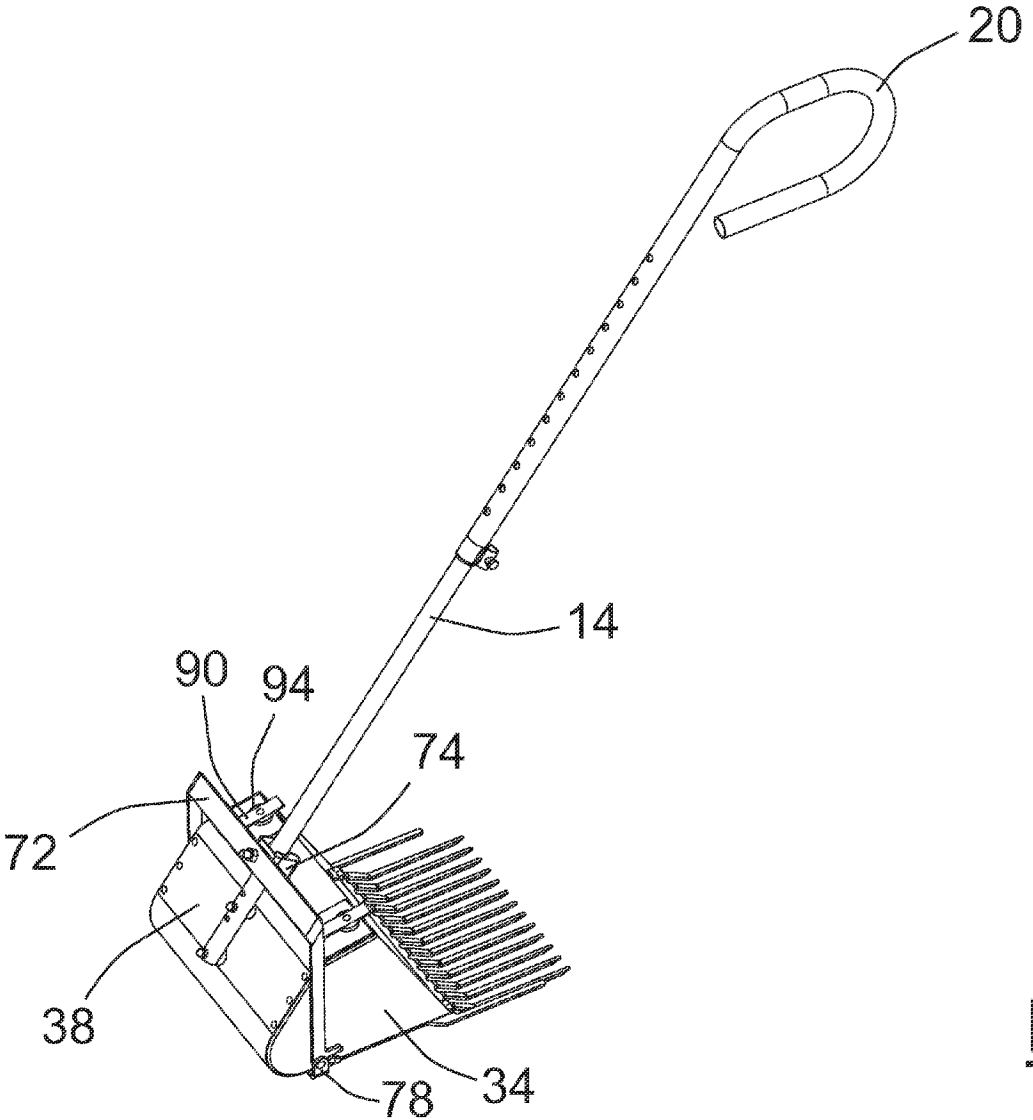
FIG. 9 is a back left perspective view of the waste removal tool of the type shown in FIG. 8.
Figure 10:
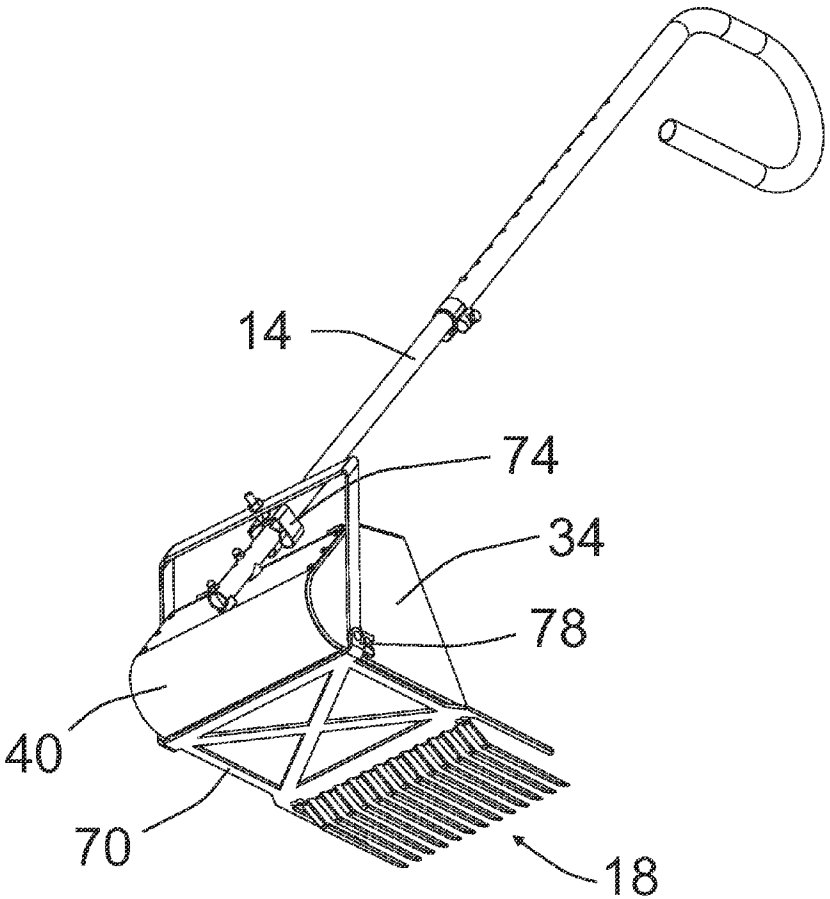
FIG. 10 is a bottom perspective view of the waste removal tool of the type shown in FIG. 8.
Figure 11:
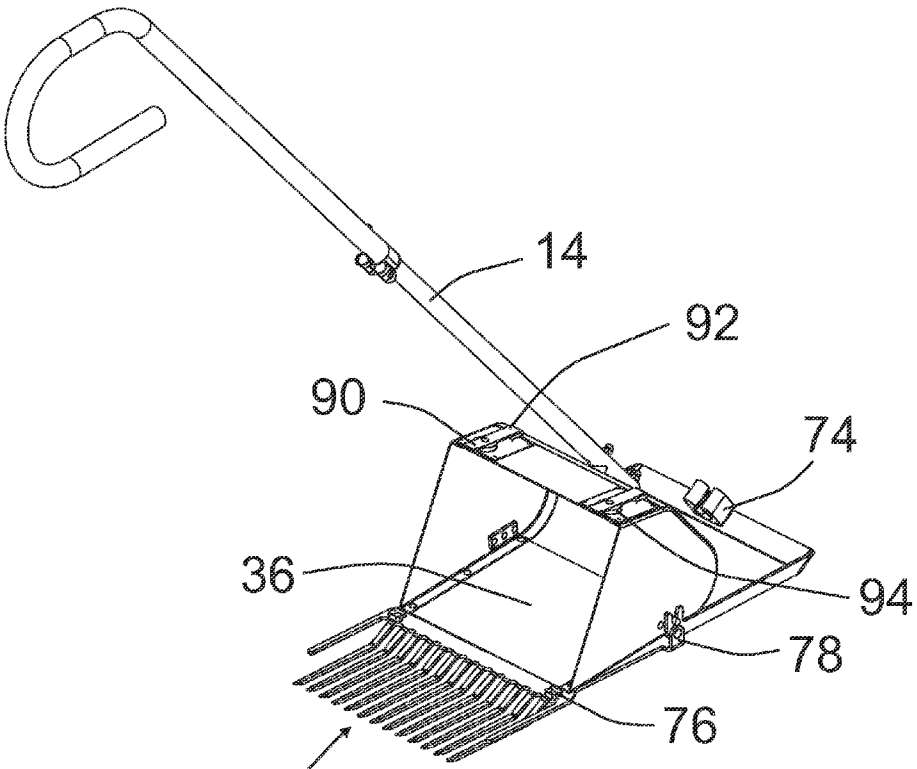
FIG. 11 is a front right perspective view of a waste removal tool in accordance with an embodiment of the invention illustrating initial disengagement of a tine assembly from a scoop.
Figure 12:
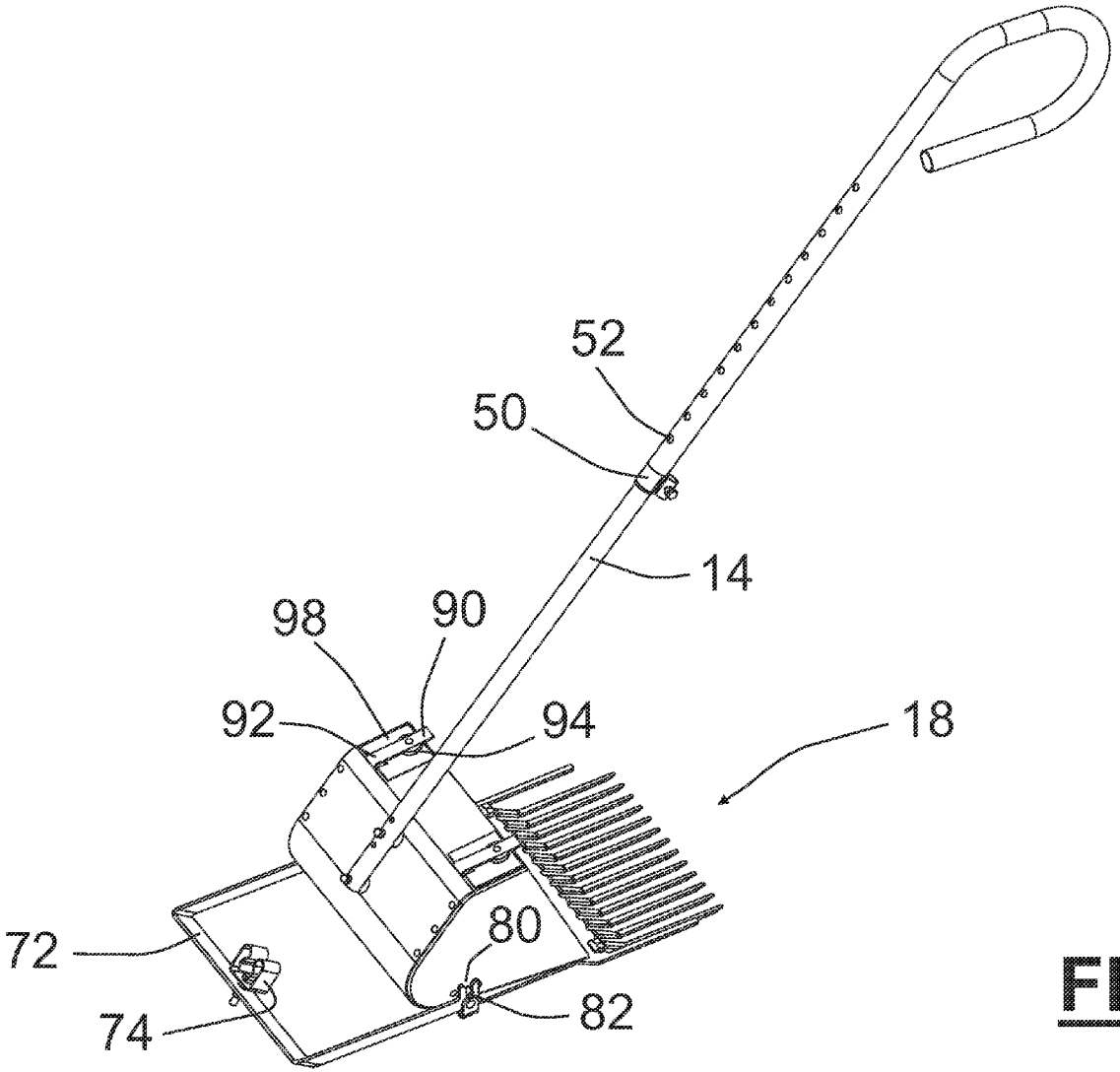
FIG. 12 is a back left perspective view of the waste removal tool of the type shown in FIG. 11.
Figure 13:
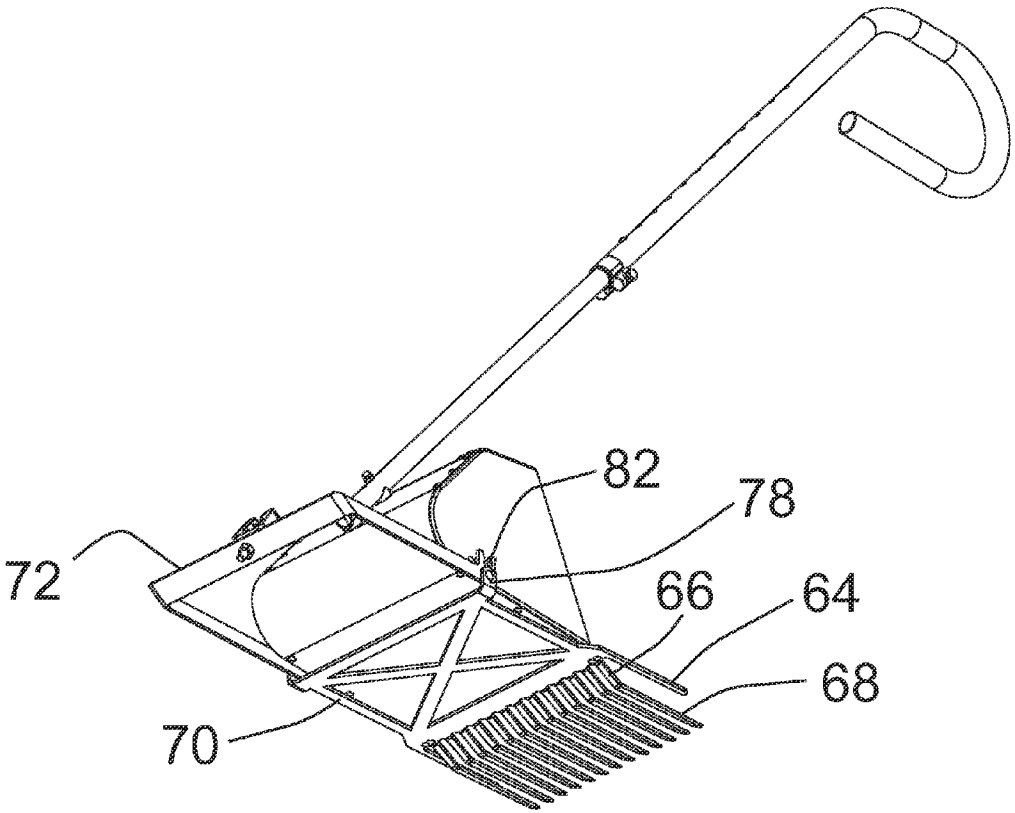
FIG. 13 is a bottom back left perspective view of the waste removal tool of the type shown in FIG. 11.
Figure 14:
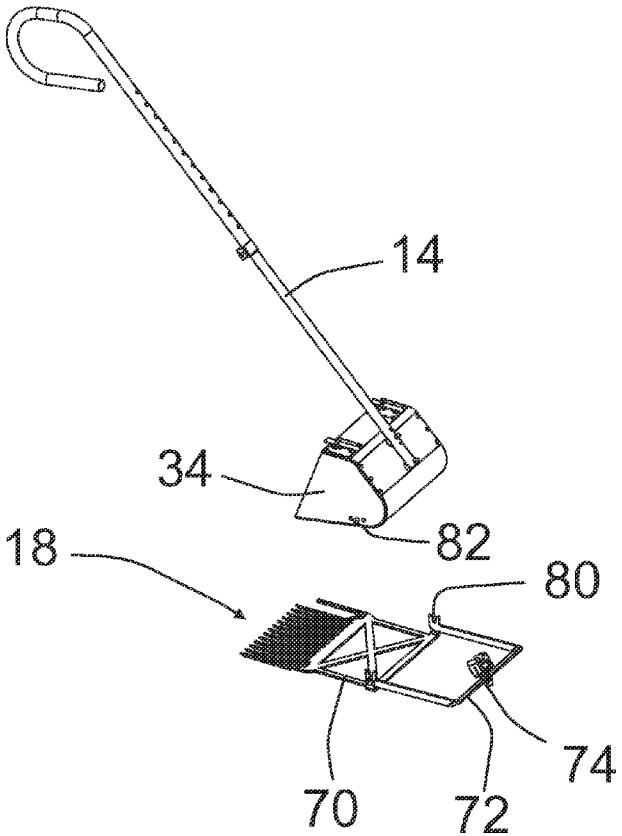
FIG. 14 is a back right perspective view of a waste removal tool in accordance with an embodiment of the invention illustrating disengagement of a tine assembly from a scoop.
Figure 15:
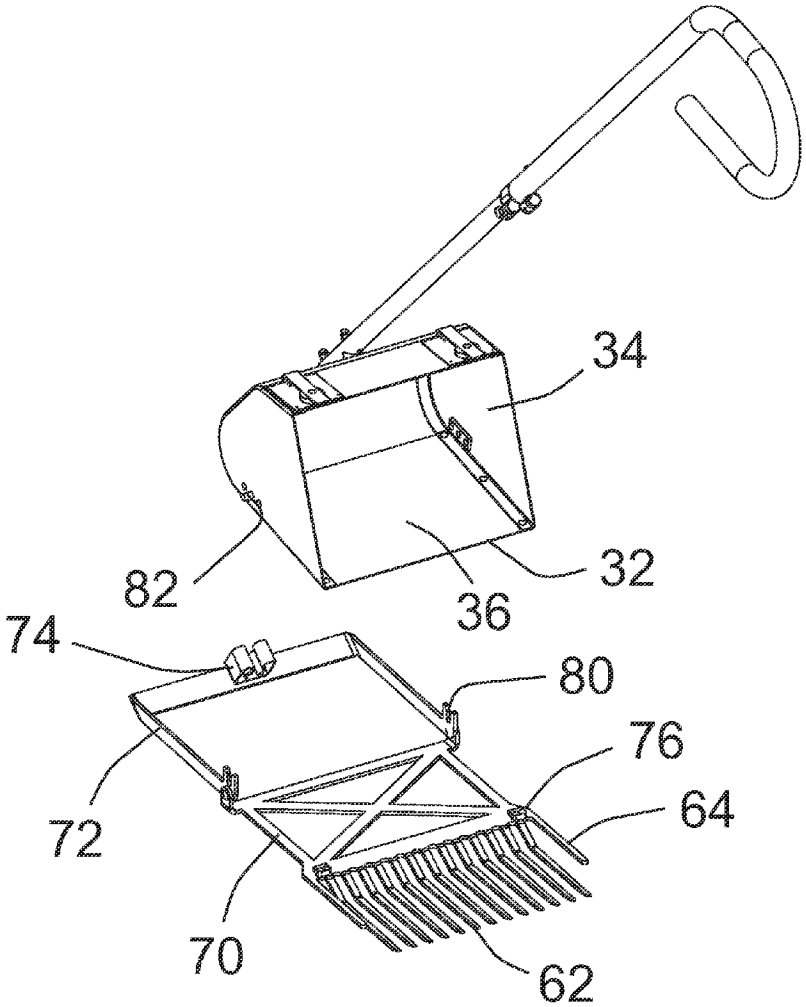
FIG. 15 is a front left perspective view of the waste removal tool of the type shown in FIG. 11.
Figure 16:
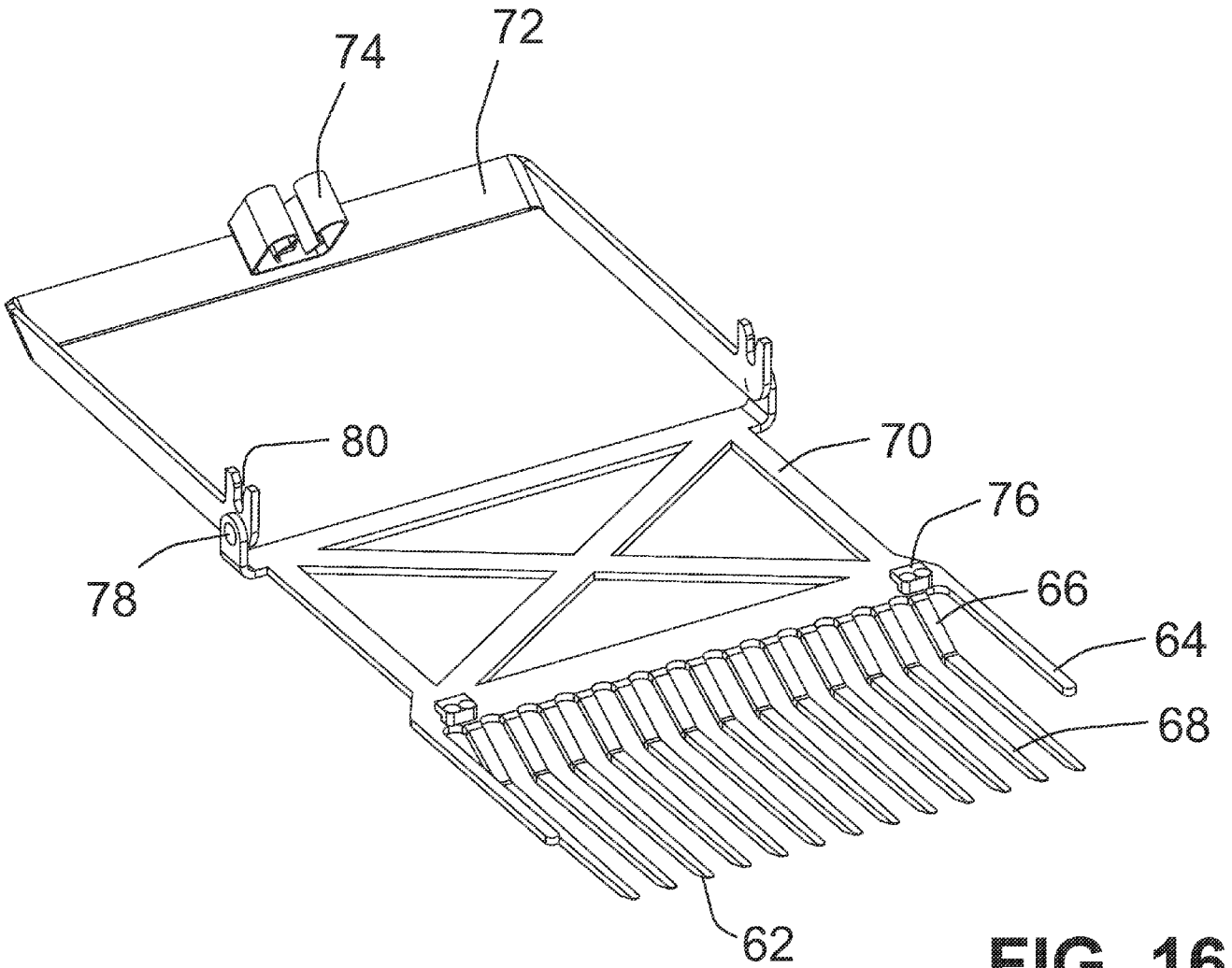
FIG. 16 is a front left perspective view of a tine assembly in accordance with an embodiment of the invention.
Figure 17:
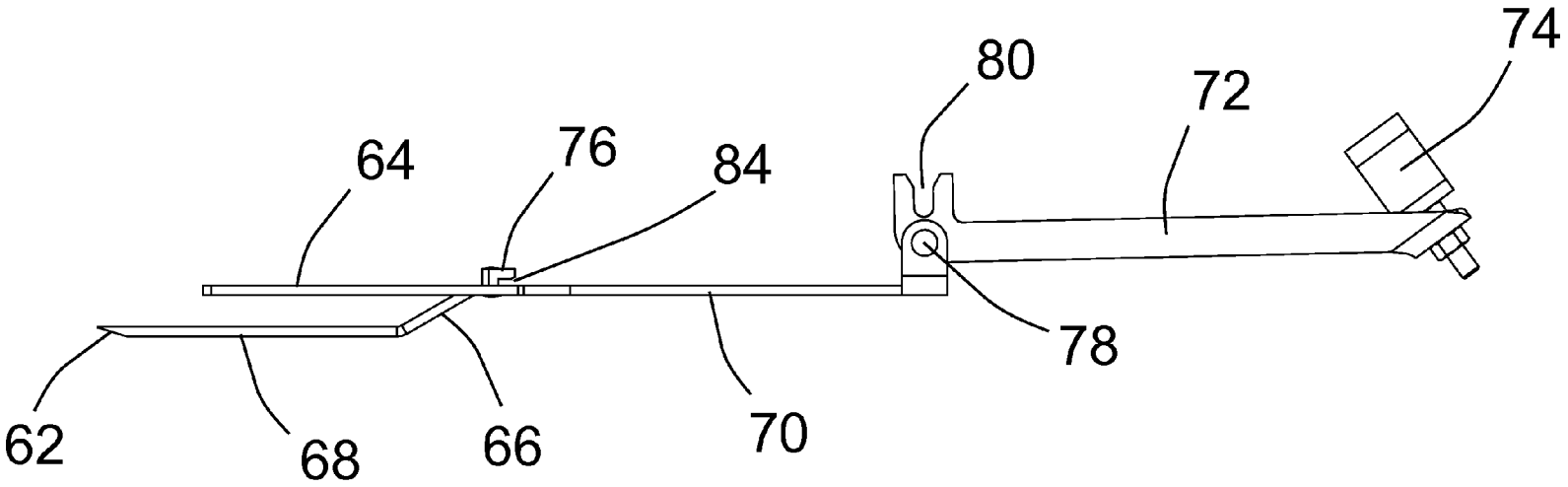
FIG. 17 is a right side elevational view of the tine assembly of the type shown in FIG. 16.
Figure 18:
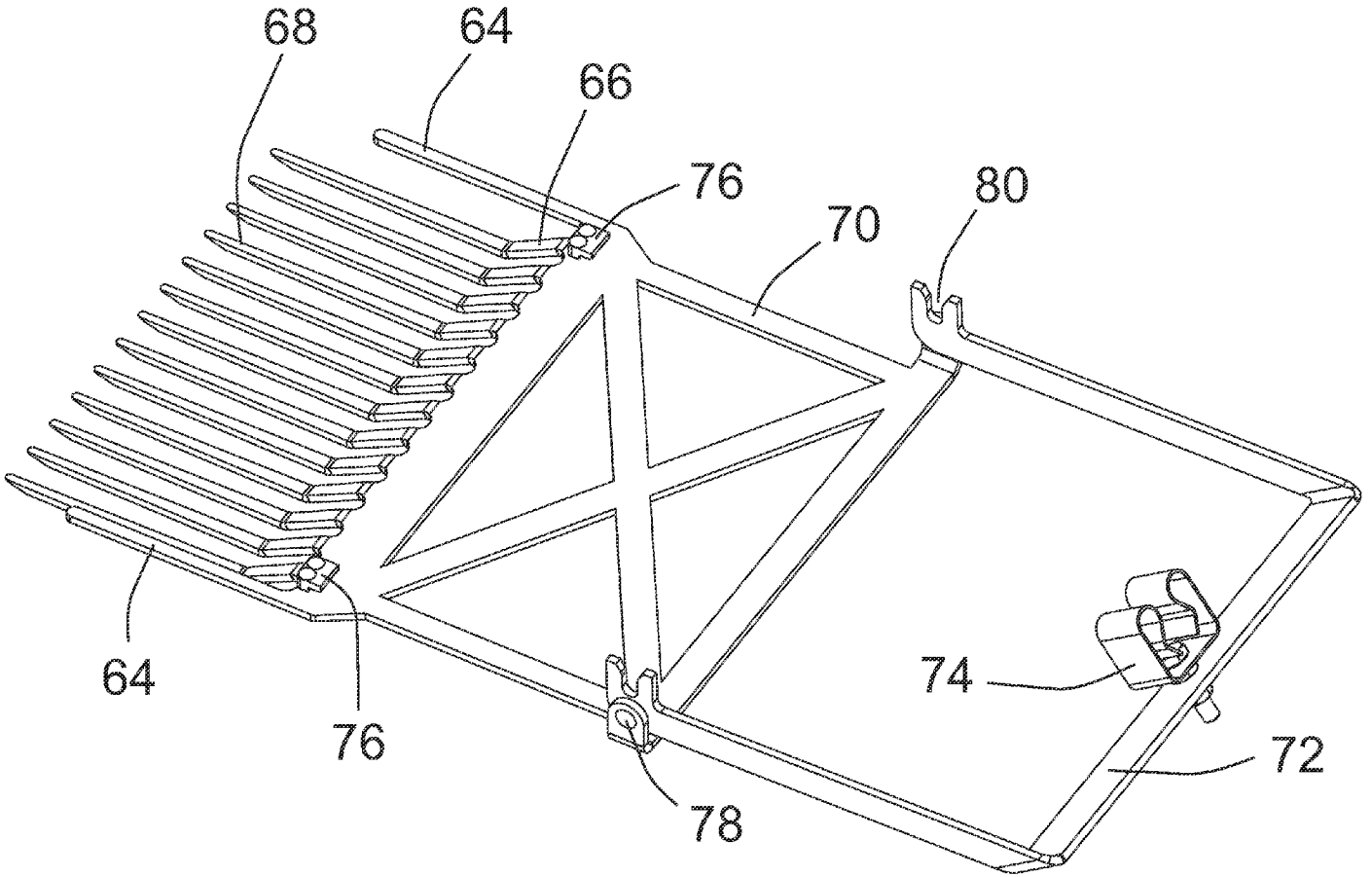
FIG. 18 is a back right perspective view of the tine assembly of the type shown in FIG. 16.
Figure 19:
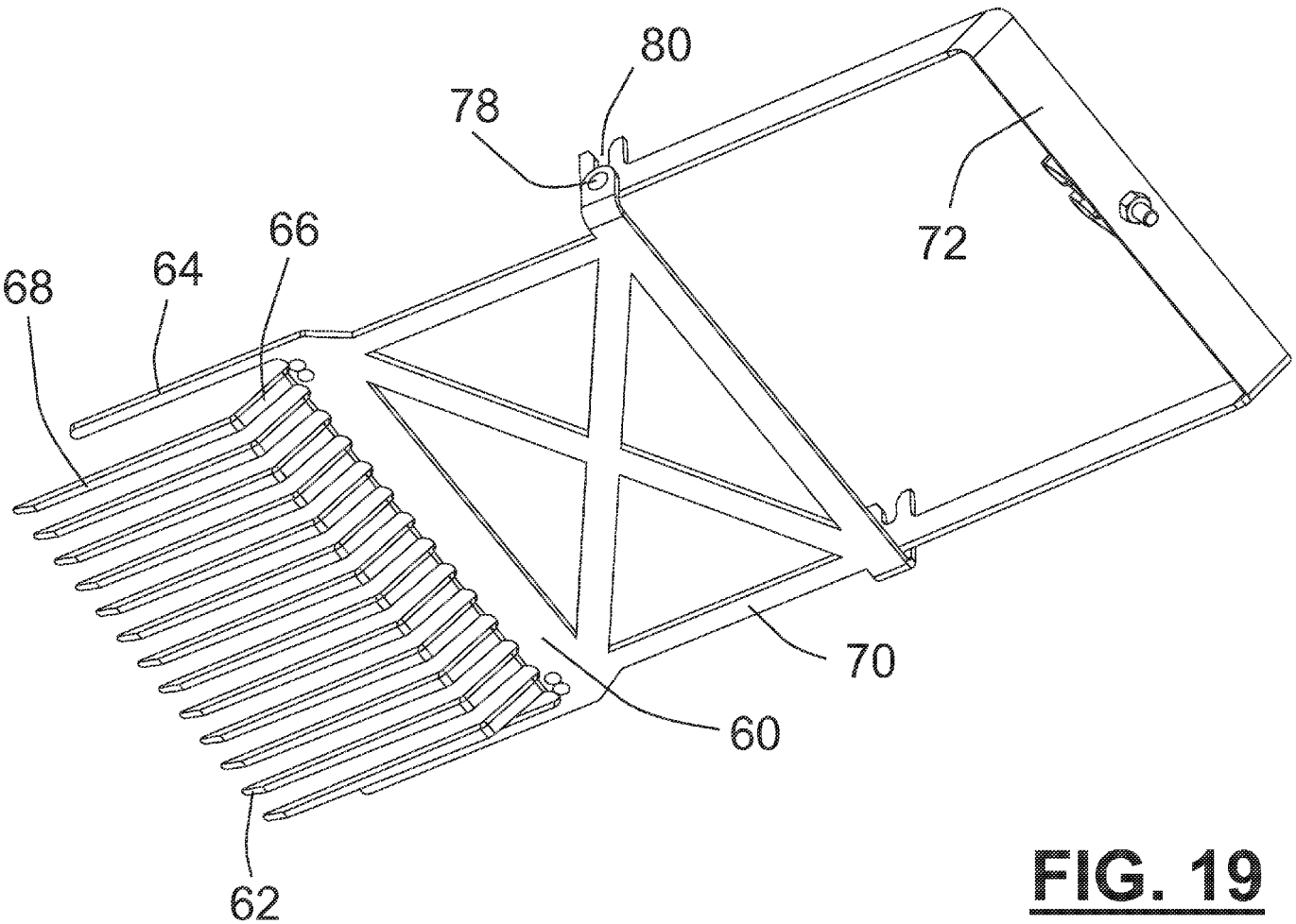
FIG. 19 is a bottom right perspective view of the tine assembly of the type shown in FIG. 16.

FIGS. 8-15 illustrates an embodiment of the removable tines 18 engaged and disengaged to the bucket 16 and handle 14. As shown in FIGS. 8-10 the lower edge 32 of the bucket engages channels 84, slot 80 engages around pin 82, and tine handle 72 is rotated to engage clamp 74 to handle 14. FIGS. 11-13 depict the tine handle 72 and clamp 74 disengaged from handle 14 and rotated away from bucket 16 about 82. As shown in FIGS. 14 and 15, lower edge 32 of bucket 16 is slid out of engagement with channel 84 of clip 76 and the bucket and handle are elevated above tine frame 70.

In use, it may be desirable to line the bucket 16 with a waste bag before attaching the tines 18 to the bucket. The opening of the bag may overlap the outer edge 30 of the bucket and the remaining portion of the bag may be pressed into the bucket. Bag retention member 90 includes a flexible spring clasp 92 with a magnet 94 on a free end. The open end of the bag overlapping the outer edge of the bucket may be sandwiched between the magnet 94 and a metal plate 98 attached to the bucket. The attraction between the metal plate and the magnet further restricts movement of the bag between the spring clasp 92 and the bucket. Once the bag is positioned surrounding the outer edge of the bucket, the bucket is lowered, engaging pins 82 into slots 80 and the lower edge 32 (having the bag enveloping the lower edge) resting on top surface of tine frame 70. The tine handle 72 is then rotated upward toward handle 14 until clamp 74 engages handle 14. This action pushes lower edge 32 under clips 76 and into channel 84, thereby securing bucket 16 to tine frame 70. After bag is filled with waste, the user may disengage bucket 16 from tine frame 70 by rotating tine handle 72 downward and away from handle 14. The upper edge of bag can be released by opening the bag retention member 90. With bucket 16 separated from tine frame 70, the bag can be easily removed from bucket 16. To remove the bag, the user lifts up on the flexible spring clasp 92 and slides the bag out of engagement with the bucket.

These and various other aspects and features of the invention are described with the intent to be illustrative, and not restrictive. This invention has been described herein with detail in order to comply with the patent statutes and to provide those skilled in the art with information needed to apply the novel principles and to construct and use such specialized components as are required. It is to be understood, however, that the invention can be carried out by specifically different constructions, and that various modifications, both as to the construction and operating procedures, can be accomplished without departing from the scope of the invention. Further, in the appended claims, the transitional terms comprising and including are used in the open ended sense in that elements in addition to those enumerated may also be present. Other examples will be apparent to those of skill in the art upon reviewing this document.

What is claimed is:

1. An animal waste removal apparatus, said apparatus comprising:

a waste receptacle having a forward facing edge defining an opening into the receptacle;

a row of tines extending from the forward facing edge of said receptacle and offset from a lower outer edge of said receptacle, said tines having a lowered bevel portion; and a handle affixed to a rear portion of said receptacle extending upward and outward in a forward facing direction, and extending above said row of tines.

2. The apparatus as recited in claim 1, wherein said row of tines includes an outer tine on each end of the row of tines that is not offset from the lower outer edge of said receptacle.

3. The apparatus as recited in claim 1, wherein said row of tines are attached to said receptacle in a fixed relation.

4. The apparatus as recited in claim 1, wherein said row of tines are attached to said receptacle with a hinge allowing the tines to rotate away from said receptacle.

5. The apparatus as recited in claim 4, further including a retention member to hold a bag within said receptacle.

6. The apparatus as recited in claim 5, wherein a portion of said retention member is magnetic.

7. The apparatus as recited in claim 4 wherein said row of tines includes a clip member to clip the row of tines to the lower outer edge of said receptacle.

8. The apparatus as recited in claim 1, wherein said handle is extendable and includes a looped grip.

9. An animal waste removal apparatus, said apparatus comprising:

a waste receptacle having a forward facing edge defining an opening into the receptacle;

a row of chisel tines extending from the forward facing edge of said receptacle and offset from a lower outer edge of said receptacle, said row of chisel tines including an outer tine on each end of the row of tines that is not offset from the lower outer edge of said receptacle; and a handle affixed to a rear portion of said receptacle and extending upward, outward in a forward facing direction, and above said row of tines.

10. The apparatus as recited in claim 9, wherein said row of tines are attached to said receptacle in a fixed relation.

11. The apparatus as recited in claim 9, wherein said row of tines are attached to said receptacle with a hinge allowing the tines to rotate away from said receptacle.

12. The apparatus as recited in claim 11, further including a retention member to hold a bag within said receptacle.

13. The apparatus as recited in claim 12, wherein a portion of said retention member is magnetic.

14. The apparatus as recited in claim 11 wherein said row of tines includes a clip member to clip the row of tines to the lower outer edge of said receptacle.

15. An animal waste removal apparatus, said apparatus comprising:

a waste receptacle having a forward facing edge defining an opening into the receptacle and a rounded back portion;

a row of chisel tines extending from the forward facing edge of said receptacle and offset from a lower outer edge of said receptacle;

a handle affixed to a rear portion of said receptacle; and a clip member to clip the row of tines to the lower outer edge of said receptacle, wherein said row of tines are attached to said receptacle with a hinge allowing the tines to rotate away from said receptacle.

16. The apparatus as recited in claim 15, wherein said row of tines includes an outer tine on each end of the row of tines that is not offset from the lower outer edge of said receptacle.

17. The apparatus as recited in claim 15, further including a retention member to hold a bag within said receptacle.

18. The apparatus as recited in claim 17, wherein a portion of said retention member is magnetic.

19. The apparatus as recited in claim 15, wherein said handle extends upward and outward in a forward facing direction, and above said row of tines.

20. The apparatus as recited in claim 19, wherein said handle includes a looped hand grip.

* * * * *